US005873754A

United States Patent [19]

Hotea

[11] Patent Number: 5,873,754

[45] Date of Patent: Feb. 23, 1999

[54] ELECTRICAL TERMINAL

[75] Inventor: Gheorghe Hotea, Griesheim, Germany

[73] Assignee: The Whitaker Corporation, Wilmington, Del.

[21] Appl. No.: 874,858

[22] Filed: Jun. 13, 1997

[30] Foreign Application Priority Data

Jun. 20, 1996 [GB] United Kingdom ..... 9612922

[51] Int. Cl.[6] ..... H01R 13/187

[52] U.S. Cl. ..... 439/843

[58] Field of Search ..... 439/842, 843, 439/845, 851, 852

[56] References Cited

U.S. PATENT DOCUMENTS 4,031,614 6/1977 Gipe .

FOREIGN PATENT DOCUMENTS 2 627 020 8/1989 France ..... H01R 11/22

*Primary Examiner*—Khiem Nguyen

*Attorney, Agent, or Firm*—Driscoll A. Nina

[57] ABSTRACT

A single piece electrical receptacle terminal is provided with a compact rigidified transition section that interconnects the connection section to the contact section. A side wall of the transition section is provided with flaps that are crimped over the opposite side wall. Extensions of the contact arms are sandwiched between the transition section side walls. A particularly rigid and compact transition section is thus provided. The latter also enables greater access to the connection end of the box-shaped outer body for secondary locking thereof.

18 Claims, 3 Drawing Sheets

ELECTRICAL TERMINAL

BACKGROUND OF THE INVENTION

1. Field of the Invention

This invention relates to an electrical receptacle terminal stamped and formed from sheet metal.

2. Description of the Prior Art

Many electrical receptacle terminals comprise a pair of opposed cantilever beam contact arms, extending from a base portion to free ends that are biasable apart for receiving a complementary tab terminal therebetween. In order to protect the contact arms, and to provide support for the terminal in a connector housing, an outer box is provided around the contact portion. This may be a separate stamped and formed box, or integral with the contact portion. French Patent Application 88 01454 discloses a single piece receptacle terminal having cantilever beam contact arms surrounded by a box shaped outer body, the contact arms being attached to the box at a centrally located seam thereof. Attachment portions of the contact arms are thus substantially contiguous in a central plane in the outer box.

Single piece receptacle terminals are generally considered as more cost-effective to manufacture than two-piece electrical terminals. Materials for single piece electrical terminals must however be selected not only for mechanical, but also electrical properties, the latter usually leading to a compromise between required strength and electrical conductivity. In order to enable greater freedom in the choice of material, and in the design of the terminal to provide functional features such as locking shoulders, it is desirable to enhance the robustness whilst maintaining the terminal compact and cost-effective. In addition, it is desirable to enhance the electrical conductivity of the terminal, in particular to prevent overheating, thereby increasing the current carrying capacity.

SUMMARY OF THE INVENTION

It is an object of this invention to provide an improved electrical terminal, which is robust, yet compact and cost-effective. In addition, it is desirable to enhance the electrical conductivity of the terminal in particular to prevent overheating, thereby increasing the current carrying capacity.

Objects of this invention have been achieved by providing the terminal according to claim 1. Advantageously, a robust electrical receptacle terminal is provided. In particular, a robust but compact transition section is provided, allowing good access to locking shoulders at an end of the contact section.

Further advantageous aspects of this invention will be apparent from the following description and claims.

DETAILED DESCRIPTION OF THE PREFERRED EMBODIMENT

Figure 1:
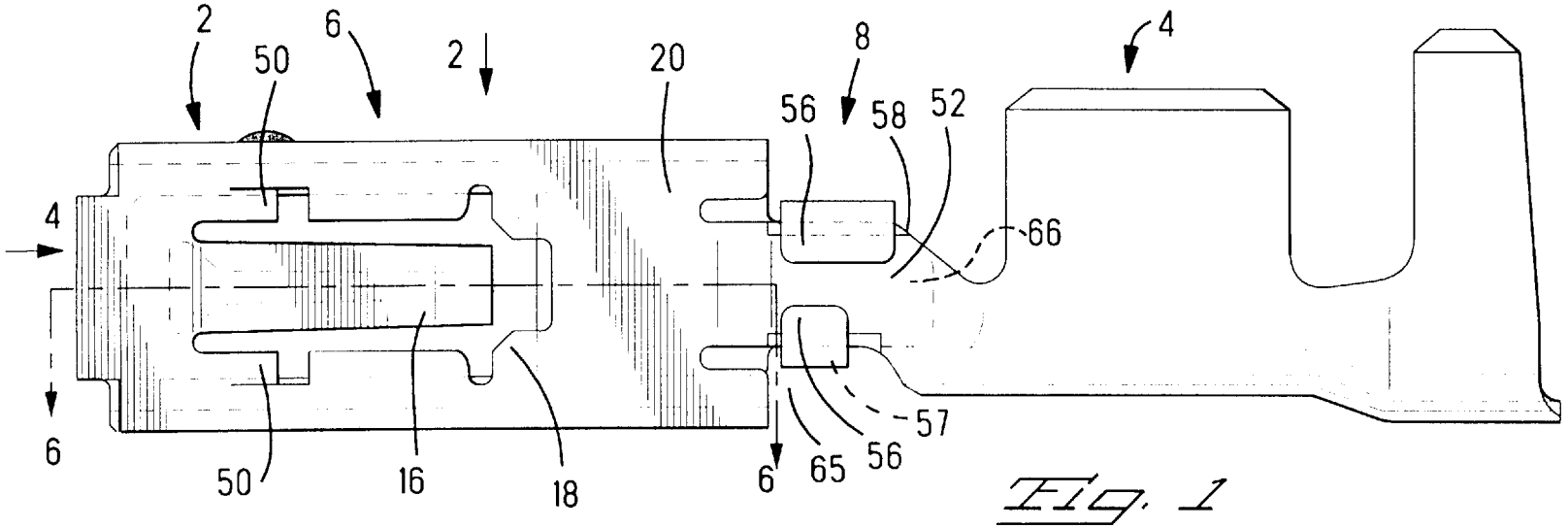
FIG. 1 is a side plan view of a terminal according to this invention.

Referring to FIGS. 1–7, an electrical receptacle terminal 2 comprises a connection section 4 for connection to a conducting wire, a contact section 6 for mating with a complementary terminal, and a transition section 8 interconnecting the connection section to the contact section. The connection section 4 comprises a crimping barrel 4, widely used in the industry, but other connection section designs could be considered, for example insulation displacement contacts (IDC). The terminal is stamped and formed from sheet metal.

The contact section 6 comprises an outer box-shaped body 10 surrounding contact members 12 within the box, further comprising a retention portion 14 in the form of resilient outwardly biased locking lances 16 attached in a cantilever fashion to the outer body 10. The locking lances 16 engage complementary shoulders of a connector housing for retaining the terminal therein. The locking lances 16 are flanked by flaps 18 bent outwardly from side walls 20 of the outer box and extending alongside opposite corners formed by side edges and free end of the locking lance. The flaps prevent wires or other foreign objects from catching under the locking lance, and furthermore enable extraction through an elastomeric seal member, without damaging the lance. The flaps provide mechanical protection for the locking lances. The outer body comprises side walls 20, and top and bottom walls 22, 24 respectively. The top wall 22 comprises a seam 26 resulting from the folding together of the stamped and formed body. Attachment portions 30 of the inner contact members 12 are integrally attached to the outer body 10 at the seam 26 of the top wall 22, via L-shaped corner portions 28.

The contact members 12 comprise a pair of cantilever beam contact arms 32 extending from the attachment portions 30. The opposed attachment portions 30 extend from the top wall 22, to proximate the bottom wall 24, the attachment portions being contiguous each other and proximate a central plane of symmetry of the outer body 10 extending in the direction of mating of the contact. Free mating ends 34 of the contact arms 32 provide a funnel shaped entry portion to receive a complementary tab terminal between opposed arcuate contact portions 36. The outer body 10 is provided with U-shaped flaps 38 that fold over the contact arm free ends 34, the flaps 38 attached to the side walls 20 at a mating end 40 of the terminal. The mating end flaps 38 protect the contact arms from stubbing against a complementary terminal, and assist in guiding the complementary terminal between the contact portions 36.

Each of the contact arms 32 is provided with longitudinal slots 42 extending the mating direction D, the slots separating each contact arm 32 into three semi-independent contact arms 44. The slots 42 extend from proximate the attachment portion 30 to proximate the free end 34 such that each of the semi-independent contact arms 44 has some independence in its elastic movement, in particular at the position of the contact portions 36. Irregularity in planarity or angle of the mating tab terminal is thus partially compensated by the semi-independent movement of the contact arms 44. A better electrical contact is thus ensured.

The contact arms 32 abut the outer body side walls 20 at their free ends 34 and proximate their attachment ends at positions denoted 46,48 (FIG. 2) during mating with a complementary terminal. Due to the support at both ends 46,48 of the beam, increased elastic force of the contact portions 36 against the complementary terminal is provided.

In order to limit bending of the contact arms 32, anti-overstress members 50 extend inwardly from the outer body side walls 20 and are spaced by a gap from the contact portions 36 of the contact arms. Excessive biasing of the contact portion 36 is thus prevented by abutment against the anti-overstress members 50.

The transition section 8 comprises opposed side walls 52 that extend from the outer body side walls 20. One of the transition section side walls 54 is provided with locking extensions 56 extending from upper and lower edges 57,58, the locking extensions 56 being folded over the top and bottom edges 57,58 of the opposed side wall 52. The crimping of the side walls together thus rigidifies the transition section 8. The latter increases the strength of the transition section 8 against bending or buckling, and furthermore strengthens both the connection section 4 and the outer body 10 by holding the side walls 20 of the outer body more securely together. The rigidification of the transition section 8, enables it to be provided with a relatively small circumference, such that a connection section end 60 of the outer body 10 is easily accessible around the whole periphery thereof (i.e. top, bottom and side wall edges at the connection end 60 are easily accessible). The latter is particularly useful for secondary locking members of a connector housing, that slide behind the outer body connection end 60 for locking the terminal within the housing. The terminal can thus be oriented in any manner in a connector housing, as it is lockable along any wall thereof.

Figure 2:
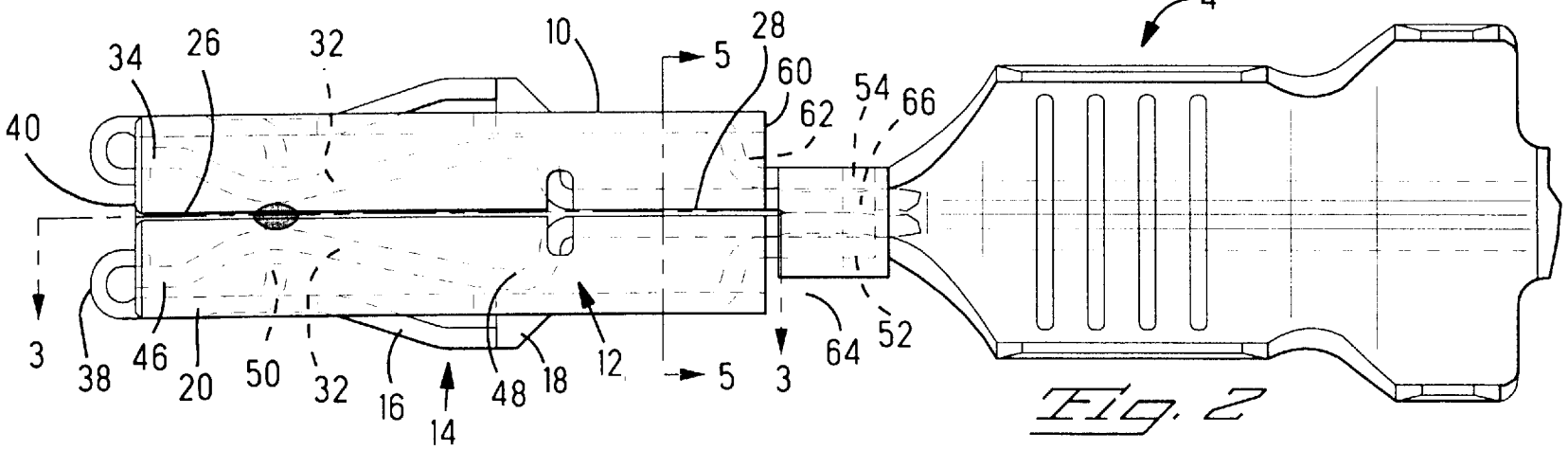
FIG. 2 is a view in the direction of arrow 2 of FIG. 1.
Figure 3:
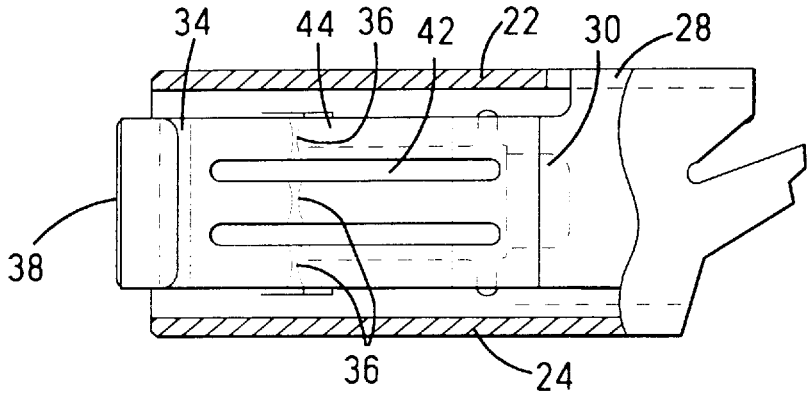
FIG. 3 is a cross-sectional view of through lines 3—3 of FIG. 2.
Figure 4:
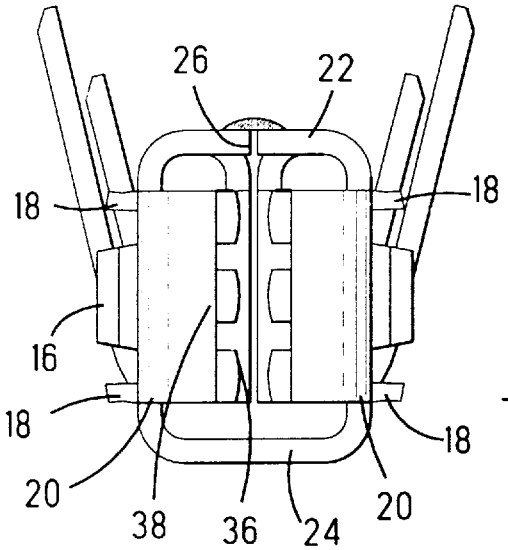
FIG. 4 is a view in the direction of arrow 4, FIG. 1.
Figure 5:
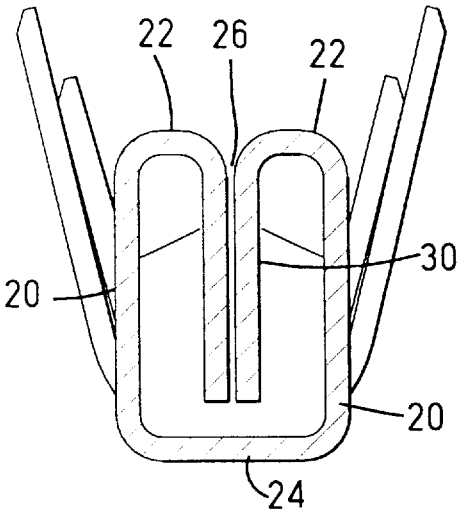
FIG. 5 is a cross-sectional view through lines 5—5 of FIG. 2.
Figure 6:
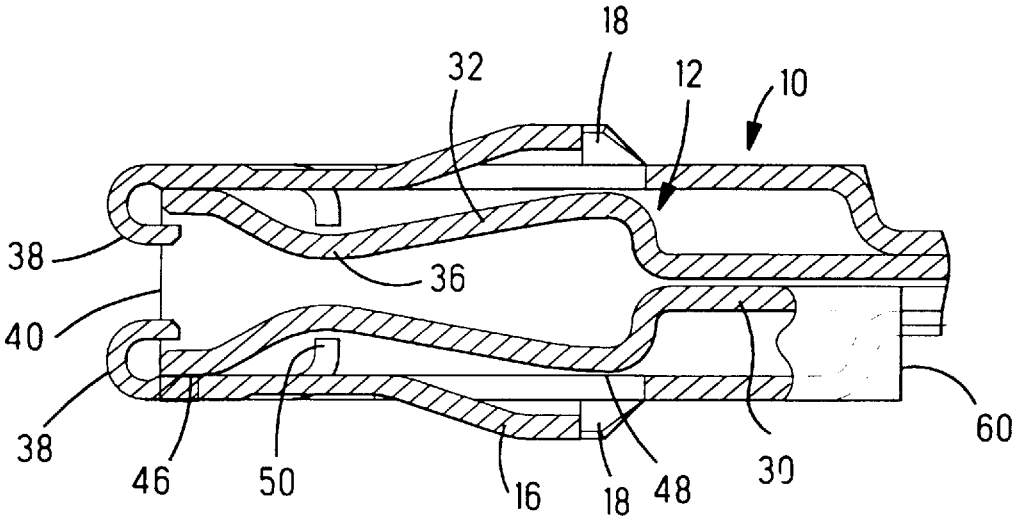
FIG. 6 is a cross-sectional view through lines 6—6 of FIG. 1.
Figure 7:
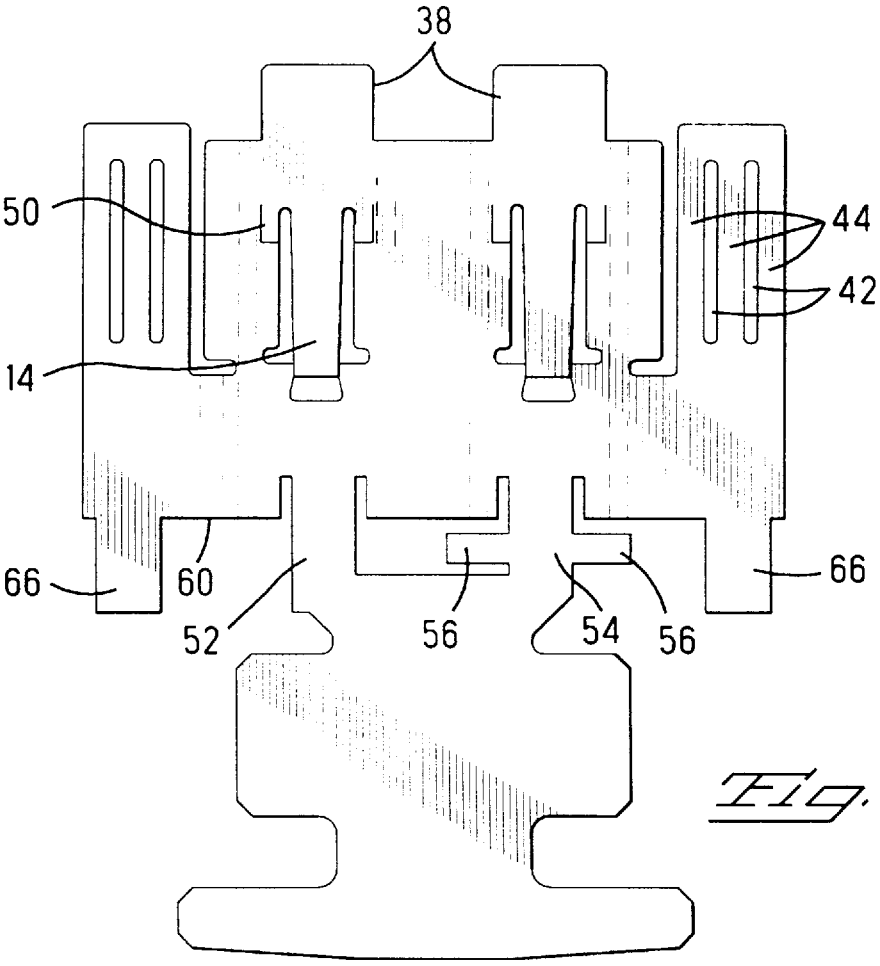
FIG. 7 is a view of the layout of the terminal prior to folding.

As shown in FIG. 2, the transition section side walls 54,52 are interconnected to the outer body side walls 20 via transition portions 62 positioned on the side of the connection end 60 that is towards the mating end 40 of the outer body, such that the outer body connection end 60 forms a peripheral shoulder freely accessible around the whole periphery. A large recess 64,65 behind the outer body 10 is thus provided for easy access of a secondary locking member. Rigidification of the transition section 8 enables a particularly compact transition section.

The contact arm attachment portions 30 comprise connection end extensions 66, that extend towards the connection section 4, beyond the outer body connection end 60. When the contact body is folded together, the extensions 66 are contiguous each other and positioned between the side walls 52, 54 of the transition section 8. Upon crimping of the locking flaps 56, the extension 66 are securely sandwiched between the transition section side walls. The secure holding together of the extensions 66, rigidifies the attachment portion end 30 of the contact arms 32, thereby increasing the elastic contact forces. Furthermore, as the attachment portions 30 extend from the outer box top walls 22, the outer box is rigidified as well. In particular, the extensions 66 significantly increase the rigidity of the transition section 8, thereby increasing its robustness with respect to bending forces exerted on the terminal between the connection and contact sections. A particularly robust, and compact single piece electrical terminal is thus provided. In addition, a compact but rigid transition section 8 enables improved access to connection end shoulders of the terminal outer body 10 for locking thereof in a connector housing. A further advantageous effect is to increase the current carrying capacity between the contact and connection on sections due to the increased conductor cross-sectional area. The latter also aids in preventing local overheating (e.g. at the contacts) due to the increased thermal conductivity between the contact and connection sections.

I claim:

1. An electrical receptacle terminal comprising a connection section for connection to a conducting wire, a contact section for mating with a complementary terminal, and a transition section extending integrally therebetween, wherein transition section side walls are securely crimped together by provision of an extension integral with one of the side walls and folded around the other side wall, the side walls extending from respective opposed side walls of an outer body.

2. The terminal of claim 1 wherein the contact section comprises opposed contacts surrounded by an outer body extending from a connection section end to a mating end.

3. The terminal of claim 1 wherein the transition section side walls are attached to the respective outer body side walls via respective opposed transition portions converging together and disposed on the mating end side of the outer body connection end.

4. The terminal of claim 1 wherein the outer body comprises a seam resulting from the folding together of stamped and formed sheet metal, and contact members integrally attached at the seam to the outer body proximate the connection end.

5. The terminal of claim 2 wherein the contact members comprise extensions sandwiched between the transition section side walls.

6. The terminal of claim 5 wherein the extensions are prolongations of attachment portions of the contact members, the attachment portions being integrally attached and folded from the outer body at the seam.

7. The terminal of claim 2 wherein the contact members comprise cantilever beam contact arms extending from attachment portions proximate the connection end, to free ends proximate the mating end.

8. The terminal of claim 7 wherein the contact arms abut side walls of the outer body at positions proximate the attachment portions and free ends respectively when mated with a complementary contact, for enhancing the contact force thereagainst.

9. The terminal of claim 7 wherein the contact arms comprise slots extending from proximate the free end to proximate the attachment portion, thereby separating each contact arm in at least two semi- independent contact arms.

10. An electrical receptacle terminal comprising a connection section for connection to a conducting wire, a contact section for mating with a complementary terminal, and a transition section extending therebetween, the transition section comprising opposed side walls securely crimped together, and the contact section comprising opposed contact members surrounded by an outer body extending from a connection section end to a mating end, wherein the contact members comprise extensions sandwiched between the transition section side walls.

11. The terminal of claim 10 wherein the extensions are prolongations of attachment portions of the contact members, the attachment portions being integrally attached and folded from the outer body at the seam.

12. The terminal of claim 10 wherein the contact members comprise cantilever beam contact arms extending from attachment portions proximate the connection end, to free ends proximate the mating end.

13. The terminal of claim 12 wherein the contact arms abut side walls of the outer body at positions proximate the attachment portions and free ends respectively when mated with a complementary contact, for enhancing the contact force thereagainst.

14. The terminal of claim 12 wherein the contact arms comprise slots extending from proximate the free end to proximate the attachment portion, thereby separating each contact arm in at least two semi-independent contact arms.

15. The terminal of claim 10 wherein one of the transition section side walls is provided with an extension integral therewith and folded around the other side wall.

16. The terminal of claim 10 wherein the transition section side walls extend from respective opposed side walls of the outer body.

17. The terminal of claim 15 wherein the transition section side walls are attached to the respective outer body side walls via respective opposed transition portions converging together and disposed on the mating end side of the outer body connection end.

18. The terminal of claim 10 wherein the outer body comprises a seam resulting from the folding together of stamped and formed sheet metal, and contact members integrally attached at the seam to the outer body proximate the connection end.

* * * * *